United States Patent [19]

Roberts

[11] Patent Number: 4,540,746

[45] Date of Patent: Sep. 10, 1985

[54] POLYAMIDE FIBER

[75] Inventor: Winston J. Roberts, Seaford, Del.

[73] Assignee: E. I. Du Pont de Nemours and Company, Wilmington, Del.

[21] Appl. No.: 662,582

[22] Filed: Oct. 19, 1984

Related U.S. Application Data

[63] Continuation-in-part of Ser. No. 566,868, Dec. 29, 1983.

[51] Int. Cl.[3] ..... C08L 77/00; C08G 65/00

[52] U.S. Cl. ..... 525/408; 525/430; 524/378

[58] Field of Search ..... 525/408, 430; 524/378

[56] References Cited

U.S. PATENT DOCUMENTS 3,329,557 7/1967 Magat et al. .
3,475,898 11/1969 Magat et al. .
4,052,493 10/1977 Etchells .
4,091,022 5/1978 Etchells .

FOREIGN PATENT DOCUMENTS 645900 9/1971 Japan .

*Primary Examiner*—John C. Bleutge
*Assistant Examiner*—A. L. Carrillo
*Attorney, Agent, or Firm*—Scott G. Hallquist

[57] ABSTRACT

Polyamide fibers are disclosed, said fibers comprising, as a distinct phase, from about 0.4 to about 10 weight percent, based upon weight of polyamide, of an additive mixture consisting essentially of (a) from 75 to 95 percent by weight of a low molecular weight poly(alkylene ether) component having an average molecular weight from about 1000 to about 6000; and (b) from 25 to 5 percent by weight of a high molecular weight poly(alkylene ether) component having an average molecular weight from about 70,000 to about 1,000,000.

8 Claims, No Drawings

POLYAMIDE FIBER

CROSS-REFERENCE TO RELATED APPLICATION

This application is a continuation-in-part of U.S. patent application Ser. No. 566,868, filed Dec. 29, 1983.

BACKGROUND OF THE INVENTION

This invention relates to improved polyamide fibers having enhanced luster and dye light-fastness properties and acceptable spinnability characteristics, and to processes for producing such fibers.

In general, unadulterated melt-spun polyamide fibers are relatively transparent, with a "bright", shiny or sparkling appearance. To achieve soil-hiding capability for such applications as carpets, various adulterants have been added to polyamides during polymerization or melt-spinning steps. Such adulterants impart opacity to spun fibers, which in turn provides the desired soil-hiding characteristics. For example, pigments such as titanium dioxide have been added for this purpose, in a process known as delustering. However, delustering with titanium dioxide decreases surface luster, resulting in a dull or chalky fiber finish.

To achieve a lustrous fiber with opacity, various methods have been developed for creating a multiplicity of longitudinal microscopic internal voids, typically disposed parallel to the fiber axis. These voids reflect incident light in a directional fashion (as opposed to the random scattering obtained when fibers are delustered with titanium dioxide), resulting in an opaque fiber with an aesthetically desirable silk-like luster. One method for creating such voids involves dispersing a water-soluble polymeric additive in a polyamide melt prior to melt-spinning. After spinning, a significant portion of the dispersed additive is extracted in a subsequent process step, resulting in void formation. The following references represent various adaptations of this method.

Magat et al., U.S. Pat. No. 3,329,557, disclose antistatic filaments of melt-spun synthetic linear polymers, e.g., polyamides, containing at least 2% by weight of a poly(alkylene ether) having an average molecular weight from about 600 to about 3,000,000. This additive is uniformly dispersed in the polymer melt prior to spinning, and can be partially extracted in an aqueous scouring step to achieve some void formation. A residue of the additive remains after scouring, which provides the anti-static properties. According to this reference, preferred additives for polyamide fibers are poly(ethylene ether) glycols having an average molecular weight from about 10,000 to 500,000, which are present in amounts ranging from 3% to 15% by weight.

Magat et al., U.S. Pat. No. 3,475,898, disclose static-resistant melt-spun polyamide fibers, containing as a distinct phase at least 2% by weight, based on polyamide, of a high molecular weight water-soluble poly(alkylene ether). In a preferred embodiment, between 3% and 15% by weight of a water-soluble poly(alkylene ether) glycol of average molecular weight from 1,000 to 30,000 is added to polyamide melts prior to spinning.

Etchells, U.S. Pat. Nos. 4,052,493 and 4,091,022, discloses polyamide fibers comprising between 1% and 14% by weight of an additive produced by reaction of boric acid and a poly(oxyalkylene) material having an average molecular weight of at least 600. According to this reference, addition of borate derivatives of poly(oxyalkylene) materials to polyamide fibers tends to eliminate certain detrimental effects upon dye light-fastness associated with poly(oxyalkylene) additives.

Kato et al., Japanese Patent No. 645,900, disclose anti-static polyamide fibers comprising at least 1% by weight of a mixture of poly(alkylene ether) materials of varying molecular weight. Specifically, this reference discloses additive mixtures containing between 10% and 70% by weight of poly(alkylene ether) compounds having 40 moles or less of alkylene oxide adduct units (implying a molecular weight up to about 1760) in combination with between 90% and 30% by weight of poly(alkylene ether) compounds having 100 moles or greater of alkylene oxide adduct units (implying a molecular weight greater than about 4400). According to this reference, such additive mixtures impart anti-static and water-absorbing qualities to polyamide fibers.

The foregoing methods of achieving void formation in melt-spun polyamide fibers, while useful, are complicated by considerations relating to the manufacturing process. Generally, poly(alkylene ether) compounds of low molecular weight are easily extracted from fibers in an aqueous scouring step, resulting in void formation. In practice, however, addition of more than 1% by weight of such materials significantly reduces the viscosity of polyamide melt-spinning mixtures, degrading the spinnability characteristics of the mixtures. Poly(alkylene ether) compounds of high molecular weight do not degrade viscosity, but are relatively more difficult to extract from spun fibers, thus negatively affecting void formation. In addition, residues of poly(alkylene ethers), upon standing, deleteriously affect dye light-fastness properties.

Addition of conjugates of boric acid and poly(alkylene ethers) partially alleviates the foregoing difficulties, since such materials are readily extractable from spun fibers, improving dye light-fastness. However, such materials are susceptible to hydrolysis as a result of absorption of atmospheric moisture. If these materials are not prepared, stored, and used in a manner designed to preclude contact with the atmosphere, their use can significantly decrease the viscosity of polyamide melts, degrading fiber spinnability.

Accordingly, improved polyamide fibers incorporating stable additives which provide a silk-like luster, acceptable dye light-fastness, a minimum of manufacturing complications, and uncompromised spinnability characteristics are of interest to the fiber and textile industries.

SUMMARY OF THE INVENTION

The present invention provides a polyamide fiber comprising, as a distinct phase, from about 0.4 to about 10 weight percent, based upon weight of polyamide, of an additive mixture consisting essentially of (a) from 75 to 95 percent by weight of a low molecular weight poly(alkylene ether) component having an average molecular weight from about 1000 to about 6000; and (b) from 25 to 5 percent by weight of a high molecular weight poly(alkylene ether) component having an average molecular weight from about 70,000 to about 1,000,000.

In addition, the present invention provides processes for making polyamide fibers, comprising adding the foregoing additive mixture of fiber-forming polyamides prior to spinning.

DETAILED DESCRIPTION OF THE INVENTION

The present invention provides new polyamide fibers comprising extractable dispersed additives which are mixtures of low and high molecular weight poly(alkylene ether) components. Fibers produced in accordance with the invention exhibit satisfactory spinnability characteristics, as a result of the enhanced viscosity control provided by addition of a high molecular weight additive component. However, from 75 to 95 percent of the dispersed additive mixture is in the form of a low molecular weight component, which is readily extractable from spun fibers, creating a multiplicity of internal microscopic voids. These voids render the resulting fibers more or less opaque, and provide an aesthetically desirable silk-like pearlescence or surface luster. Further, the fibers of the present invention also exhibit favorable dye light-fastness characteristics.

In the context of the present invention, "polyamide" refers to polyhexamethylene adipamide and polycaproamide or copolymers thereof.

The poly(alkylene ethers) employed in preparing the fibers disclosed herein are either ethylene oxide or ethylene oxide-higher alkylene oxide condensation polymers. These materials consist predominantly of repeating divalent ether radicals selected from the group consisting of ethylene ether, propylene ether, isopropylene ether and tetramethylene ether, with the proviso that there be sufficient ethylene ether radicals to render the resulting polymer water-soluble. Further, the poly(alkylene ethers) selected must not comprise functional groups which are reactive with the polyamides to which they are added, and should be stable under melt-spinning conditions. Preferred poly(alkylene ethers) for making the fibers of the invention are poly(ethylene ether) glycols.

As used throughout the specification, the terms "low molecular weight poly(alkylene ether) component" and "high molecular weight poly(alkylene ether) component" refer to materials which are actually mixtures of molecules within a relatively narrow range of molecular weights. However, these terms can also refer to mixtures of two or more molecular weight classes, each of which fall within a specified range of molecular weights.

As previously noted, the low molecular weight poly(alkylene ether) component of the additive mixture has an average molecular weight from about 1000 to about 6000. Within this range, materials having average molecular weights from 1500 to 3000 are preferred. The low molecular weight component is incorporated into additive mixtures at a level of about 75 to 95 percent, based upon the weight of the additive mixture. A preferred weight percentage range for this component is from 80 to 92 percent.

The balance of the additive mixture is represented by a high molecular weight component, which has an average molecular weight from about 70,000 to about 1,000,000. Within this range, materials having average molecular weights from about 100,000 to about 500,000 are preferred.

The additive mixture formed from the foregoing high and low molecular weight components is incorporated into polyamide mixtures prior to melt-spinning in amounts ranging from about 0.4 to about 10 percent by weight, based upon weight of polyamide. Amounts ranging from about 1 to about 8 percent by weight are preferred, and amounts ranging from about 2 to about 6 percent by weight are particularly preferred, due to a higher degree of void formation upon aqueous extraction.

In preparing the products of the invention, poly(alkylene ethers) which do not react with polyamide can be added during polymerization or can be mixed with monomeric constituents prior to polymerization. It is typically desirable to employ a polymerization autoclave with a stirrer, to distribute additives uniformly. Stirring should be continued until the polymer is extruded. Fibers can then be melt-spun and drawn in conventional fashion.

Alternatively, the poly(alkylene ether) components of the additive mixture are mechanically mixed directly with or injected into molten, fiberforming polyamides and the resulting mixture immediately spun into fibers. This technique provides a uniform distribution of additive within the melt, and tends to minimize thermal degradation of the additive components. When the polyamide and additive mixture are melt-blended after polymerization, a mixing step is essential to distribute additive uniformly within the melt, to assure consistency of results.

Optionally, other additives, for example, pigments, antioxidants, stabilizers, or dispersed dyestuffs, can be incorporated into the fibers of the invention prior to melt-spinning.

To promote void formation, an aqueous scouring or extraction step is necessary after the fibers are melt-spun and drawn. Fibers, yarn or fabric can be water-extracted in a dye bath, or in a conventional boil-off or scour, preferably in the presence of soap, a synthetic detergent, an alkaline scouring agent, or similar composition.

As used throughout the specification, the term "fiber" refers to continuous filament (bulked or unbulked) or to staple fiber formed from homo- or copolymers.

The following examples, in which all parts and percentages are by weight, and all degrees are Celsius unless otherwise indicated, illustrate various aspects of the present invention.

EXAMPLE 1

Polyhexamethylene adipamide of 60 relative viscosity was melted in a screw extruder, then fed through a transfer line to a meter pump, filter pack and spinneret in a conventional manner. During passage of the polyhexamethylene adipamide through the transfer line, a flaked additive mixture containing 80% poly(ethylene ether) glycol (molecular weight 2750) and 20% poly(ethylene ether) glycol (molecular weight 100,000) was melted (viscosity 4000 cps at 145°) and injected into the molten polyhexamethylene adipamide at a level of 5 parts of the melted additive mixture per 95 parts polyhexamethylene adipamide. Yarn was spun as 515 trilobal filaments with a modification ratio of 1.6, drawn to 6 dpf and cut to 6.5 inch staple.

After processing into spun yarn of 6/2 cotton count and continuous heat-setting in hot air at 200°, the resulting staple was tufted to form a saxony-style carpet, then dyed in an aqueous dye bath at 99°. A portion of the additive mixture was extracted in this process. The resulting carpet was observed to have a lustrous, silk-like appearance and good dye light-fastness. Dye light-fastness was measured at 3.2 dlf units on a scale of 1 to 5, (5 being best) using a xenon source at 60 Standard Fading Units (SFU).

This carpet was compared to a carpet made substantially similarly, except that the additive mixture was omitted from the melt-spinning mixture. The carpet made from fiber from which additive was omitted was observed to have a bright, sparkling appearance. The carpet produced from fiber into which additive was incorporated did not exhibit such "sparkle", but rather, a more diffused, silk-like luster.

EXAMPLE 2

Polyhexamethylene adipamide of 60 relative viscosity was melted in a screw extruder, then fed through a transfer line to a meter pump, filter pack, and spinneret in a conventional manner. During passage of the polyhexamethylene adipamide through the transfer line, a flaked additive mixture containing 90% poly(ethylene ether) glycol (molecular weight 2750) and 10% poly(ethylene ether) glycol (molecular weight 1,000,000) was melted (viscosity 40,000 cps at 145°) and injected into the molten polyhexamethylene adipamide at a level of 5 parts additive mixture per 95 parts polyhexamethylene adipamide. Yarn was spun as 515 trilobal filaments with a modification ratio of 1.6, drawn to 6 dpf, and cut to 6.5 inch staple. After processing into a spun yarn of 6/2 cotton count, the fiber was tufted to form a saxony-style carpet, then dyed in an aqueous dye bath at 99°, resulting in extraction of additive. The resulting carpet also exhibited a silk-like luster.

This carpet was compared to a carpet made substantially similarly, except that the additive mixture was omitted from the melt-spinning mixture. The carpet made from fiber from which additive was omitted was observed to have a bright, sparkling appearance. The carpet produced from fiber into which additive was incorporated did not exhibit such "sparkle", but rather, a more diffused, silk-like luster.

COMPARATIVE EXPERIMENT A

Polyhexamethylene adipamide of 60 relative viscosity was melted in a screw extruder, then fed through a transfer line to a meter pump, filter pack, and spinneret in a conventional manner. During passage of the polyhexamethylene adipamide through the transfer line, a flake prepared from poly(ethylene ether) glycol (molecular weight 2750) was melted and injected into the molten polyhexamethylene adipamide at a level of 5 parts poly(ethylene ether) glycol per 95 parts polyhexamethylene adipamide. Attempts to spin yarn as 515 filaments with a modification ratio of 1.6 failed. This failure was attributed to insufficient viscosity of the melt-spinning mixture. The viscosity of the mixture was determined to be 42 cps at 145°.

COMPARATIVE EXPERIMENT B

Polyhexamethylene adipamide of 60 relative viscosity was melted in a screw extruder, then fed through a transfer line to a pump, filter pack, and spinneret in a conventional manner. During passage of the polyhexamethylene adipamide through the transfer line, a flake mixture of polyoxyethylene glycol (molecular weight 2750) and ortho-boric acid (0.7 mol ratio) was melted (viscosity 3500 cps at 145°) and injected into the molten polyhexamethylene adipamide at a level of 5 parts additive mixture per 95 parts polyhexamethylene adipamide. Attempts to spin yarn as 515 filaments with a modification ratio of 1.6 failed, due to insufficient viscosity of the melt-spinning mixture. It was subsequently determined that the additive mixture had lost viscosity as a result of exposure to air or water condensate in process lines.

COMPARATIVE EXPERIMENT C

Polyhexamethylene adipamide of 60 relative viscosity was melted in a screw extruder, then fed through a transfer line to a meter pump, filter pack and spinneret in a conventional manner. During passage of the molten polyhexamethylene adipamide through the transfer line, a nitrogen-protected mixture of polyoxyethylene glycol (molecular weight 2750) and ortho-boric acid (0.7 mol ratio) was melted (viscosity 4000 cps at 145°) and injected into the molten polyhexamethylene adipamide at a level of 5 parts additive per 95 parts polyhexamethylene adipamide. Yarn was spun as 515 filaments with a modification ratio of 1.6, drawn to 6 dpf and cut to 6.5 inch staple. After processing to a spun yarn of 6/2 cotton content and continuous heat-setting in hot air at 200°, the fiber ws tufted to form a saxony-style carpet, then dyed in an aqueous dye bath at 99°. The resulting carpet had a lustrous, silk-like appearance as a result of void formation within individual fibers. Dye light-fastness was measured at 3.2 dlf units on a scale of 1 to 5 (5 being best), using a xenon source at 60 SFU. When compared to the carpet of Example 1, little difference in luster or overall appearance could be detected.

EXAMPLE 3

Polyhexamethylene adipamide of 60 relative viscosity and containing 0.15% titanium dioxide pigment was melted in a screw extruder, then fed through a transfer line to a meter pump, filter pack and spinneret in a conventional manner. During passage of the polyhexamethylene adipamide through the transfer line, a flaked additive mixture containing 85% poly(ethylene ether) glycol (molecular weight 2750) and 15% poly(ethylene ether) glycol (molecular weight 100,000) was melted (viscosity 1700 cups at 145°) and injected into the molten polyhexamethylene adipamide at a level of 0.5 parts of the melted additive mixture per 100 parts polyhexamethylene adipamide. Yarn was spun as 332 trilobal filaments with modification ratios of 1.7 and 2.3, blended 50/50, drawn to 18 dpf and cut to 7.5 inch staple.

After processing into spun yarn of 6/2 cotton count and continuous heat-setting in hot air at 200°, the resulting staple was tufted to form a saxony-style carpet, then dyed in an aqueous dye bath at 99°. A portion of the additive mixture was extracted in this process. The resulting carpet was observed to have a mildly pearlescent appearance and good dye light-fastness. Dye light-fastness was measured at 4.4 dlf units on a scale of 1 to 5, (5 being best) using a xenon source at 60 Standard Fading Units (SFU).

EXAMPLE 4

Polyhexamethylene adipamide of 60 relative viscosity was melted in a screw extruder, then fed through a transfer line to a meter pump, filter pack and spinneret in a conventional manner. During passage of the polyhexamethylene adipamide through the transfer line, a flaked additive mixture containing 85% poly(ethylene ether) glycol (molecular weight 2750) and 15% poly(ethylene ether) glycol (molecular weight 100,000) was melted (viscosity 1700 cps at 145°) and injected into the molten polyhexamethylene adipamide at a level of 2.25 parts of the melted additive mixture per 100 parts polyhexamethylene adipamide. Yarn was spun as 515 trilobal filaments with a modification ratio of 1.6, drawn to 6 dpf, heatset, then cut to 6.5 inch staple.

After processing into spun yarn of 2.0/1 cotton count, the resulting staple was tufted to form a plush-style bath rug, then dyed in an aqueous dye bath at 99°. A portion of the additive mixture was extracted in this process. The resulting bath rug was observed to have a lustrous, silk-like appearance.

This carpet was compared to a carpet made substantially similarly, except that the additive mixture was omitted from the melt-spinning mixture. The carpet made from fiber from which additive was omitted was observed to have a bright, sparkling appearance. The carpet produced from fiber into which additive was incorporated did not exhibit such "sparkle", but rather, a more diffused pearlescent luster.

EXAMPLE 5

Polyhexamethylene adipamide of 60 relative viscosity was melted in a screw extruder, then fed through a transfer line to a meter pump, filter pack and spinneret in a conventional manner. During passage of the polyhexamethylene adipamide through the transfer line, a flaked additive mixture containing 88% poly(ethylene ether) glycol (molecular weight 2750) and 12% poly(ethylene ether) glycol (molecular weight 200,000) was melted (viscosity 5000 cps at 145°) and injected into the molten polyhexamethylene adipamide at a level of 8.85 parts of the melted additive mixture per 100 parts polyhexamethylene adipamide. Yarn was spun as 330 trilobal filaments with a modification ratio of 2.9, drawn to 12 dpf and cut to 7.5 inch staple.

After processing into spun yarn of 6/2 cotton count and continuous heat-setting in hot air at 200°, the resulting staple was tufted to form a saxony-style carpet, then dyed in an aqueous dye bath at 99°. A portion of the additive mixture was extracted in this process. The resulting carpet was observed to have a lustrous, silk-like appearance, although not as lustrous as fibers made with a cross section of lower modification ratio.

This carpet was compared to a carpet made substantially similarly, except that the additive mixture was omitted from the melt-spinning mixture. The carpet made from fiber from which additive was omitted was observed to have a relatively non-lustrous appearance. The carpet produced from fiber into which additive was incorporated did not exhibit such dullness, but rather, a diffused, silk-like luster.

What is claimed is:

1. A polyamide fiber comprising, as a distinct phase, from about 0.4 to about 10 weight percent, based upon weight of polyamide, of an additive mixture consisting essentially of (a) from 75 to 95 percent by weight of a low molecular weight poly(alkylene ether) component having an average molecular weight from about 1000 to about 6000; and (b) from 25 to 5 percent by weight of a high molecular weight poly(alkylene ether) component having an average molecular weight from about 70,000 to about 1,000,000.

2. A fiber according to claim 1, wherein the additive mixture is present at a level of from 1 to 8 percent by weight, based upon weight of polyamide.

3. A fiber according to claim 2, wherein both the low molecular weight poly(alkylene ether) component and the high molecular weight poly(alkylene ether) component are poly(ethylene ether) glycols.

4. A fiber according to claim 3, wherein the additive mixture consists essentially of (a) from 80 to 92 percent by weight of a low molecular weight poly(ethylene ether) glycol component having an average molecular weight from about 1500 to 3000; and (b) from 20 to 8 percent by weight of a high molecular weight poly(ethylene ether) glycol component having an average molecular weight from about 100,000 to about 500,000.

5. A fiber according to claim 4, wherein the additive mixture is present at a level of from 2 to 6 percent by weight, based upon weight of polyamide.

6. A fiber according to claim 5, wherein the low molecular weight poly(ethylene ether) glycol component has an average molecular weight of about 2750, and the high molecular weight poly(ethylene ether) glycol component has an average molecular weight of about 100,000.

7. A process for producing a melt-spun polyamide fiber, comprising admixing an additive mixture as defined in claim 1 with a fiber-forming polyamide before spinning.

8. A process for producing a melt-spun polyamide fiber, comprising admixing an additive mixture as defined in claim 2 with a fiber-forming polyamide before spinning.

* * * * *